US007141030B2

(12) United States Patent
Chen

(10) Patent No.: US 7,141,030 B2
(45) Date of Patent: Nov. 28, 2006

(54) HANDHELD MASSAGER

(76) Inventor: Chen Ching Chen, No. 80-2, Wen Yuan Road, Pei Tou, Chang Hua Hsien (TW)

( * ) Notice: Subject to any disclaimer, the term of this patent is extended or adjusted under 35 U.S.C. 154(b) by 75 days.

(21) Appl. No.: 11/035,962

(22) Filed: Jan. 18, 2005

(65) Prior Publication Data

US 2006/0161080 A1 Jul. 20, 2006

(51) Int. Cl.
*A61H 15/00* (2006.01)

(52) U.S. Cl. ..... 601/125; 601/131

(58) Field of Classification Search ..... 601/125, 601/128, 131, 132, 135, 137
See application file for complete search history.

(56) References Cited

U.S. PATENT DOCUMENTS 676,604 A * 6/1901 Fritze ..... 601/20
781,555 A * 1/1905 Schanz ..... 601/131
1,400,547 A * 12/1921 Holmstrom ..... 601/125
2,017,400 A * 10/1935 Hoyer ..... 601/135
2,797,685 A * 7/1957 Packwood ..... 601/131

* cited by examiner

*Primary Examiner*—Michael A. Brown
(74) *Attorney, Agent, or Firm*—Lowe Hauptman & Berner, LLP

(57) ABSTRACT

A handheld massager including: a main body; a first massaging member disposed on top face of the main body, a top face of the first massaging member being a domed first massaging face; and a second massaging member disposed under bottom end of the main body. The bottom face of the second massaging member has embossed structure and serves as a second massaging face. A user can select the first massaging face or the second massaging face to massage human body so that the handheld massager can be switched between different massaging modes. When a user holds the second massaging member to massage human body with the first massaging member, the second massaging face simultaneously stimulates and massages the palm of the user.

16 Claims, 8 Drawing Sheets

HANDHELD MASSAGER

BACKGROUND OF THE INVENTION

The present invention is related to a massager, and more particularly to a handheld massager which can provide different massaging effects for a user. When a user holds the massager with one hand to massage human body, the massager also massages the palm of the user.

FIG. 1 shows a conventional handheld massager 10 including a holding member 12 and a massaging ball 14 mounted in the holding member 12. A user can hold the holding member 12 with one hand and roll the massaging ball 14 back and forth on the skin. The massaging ball 14 can exert a pressure on the skin to provide a massaging effect.

The above handheld massager can only achieve monotonous massaging effect, while lacking any other massaging function.

Moreover, the above handheld massager can only provide massaging effect for human skin or body. Such massager can hardly provide any massaging effect for the user's palm.

SUMMARY OF THE INVENTION

It is therefore a primary object of the present invention to provide a handheld massager which can provide many different massaging effects for a user.

It is a further object of the present invention to provide the above handheld massager which also massages the palm of a user when the user holds the massager to massage human body.

It is still a further object of the present invention to provide the above handheld massager which can be easily held and used.

The present invention can be best understood through the following description and accompanying drawings wherein:

DETAILED DESCRIPTION OF THE PREFERRED EMBODIMENTS

Figure 1:
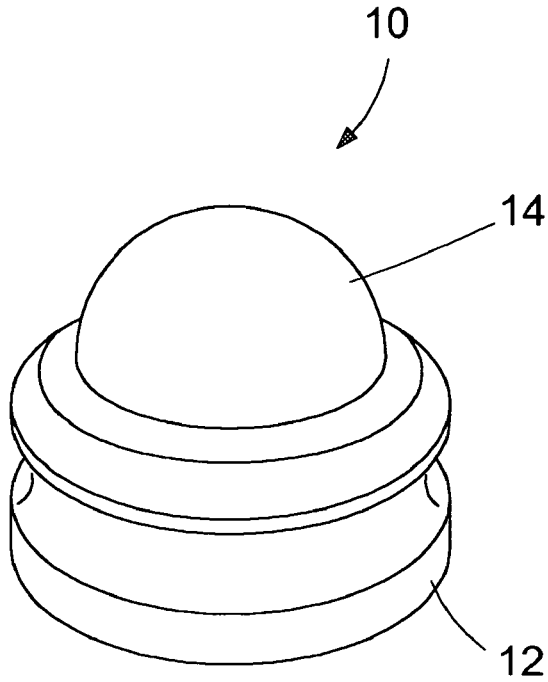
Fig. 1 PRIOR ART
FIG. 1 is a perspective view of a conventional massager.
Figure 2:
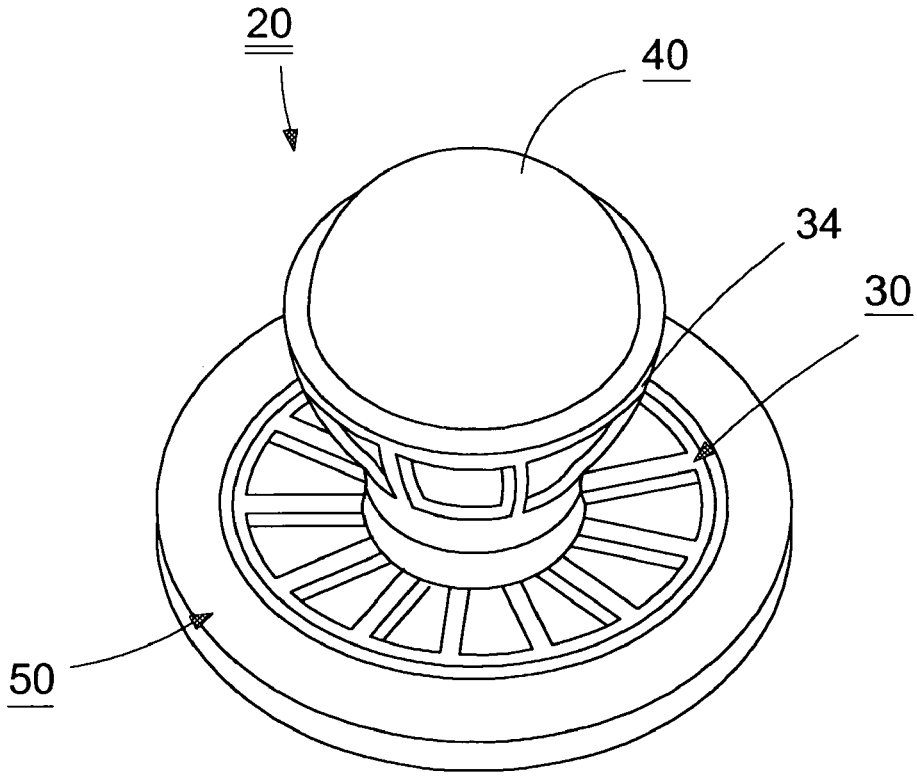
FIG. 2 is a perspective assembled view of a first embodiment of the massager of the present invention.
Figure 3:
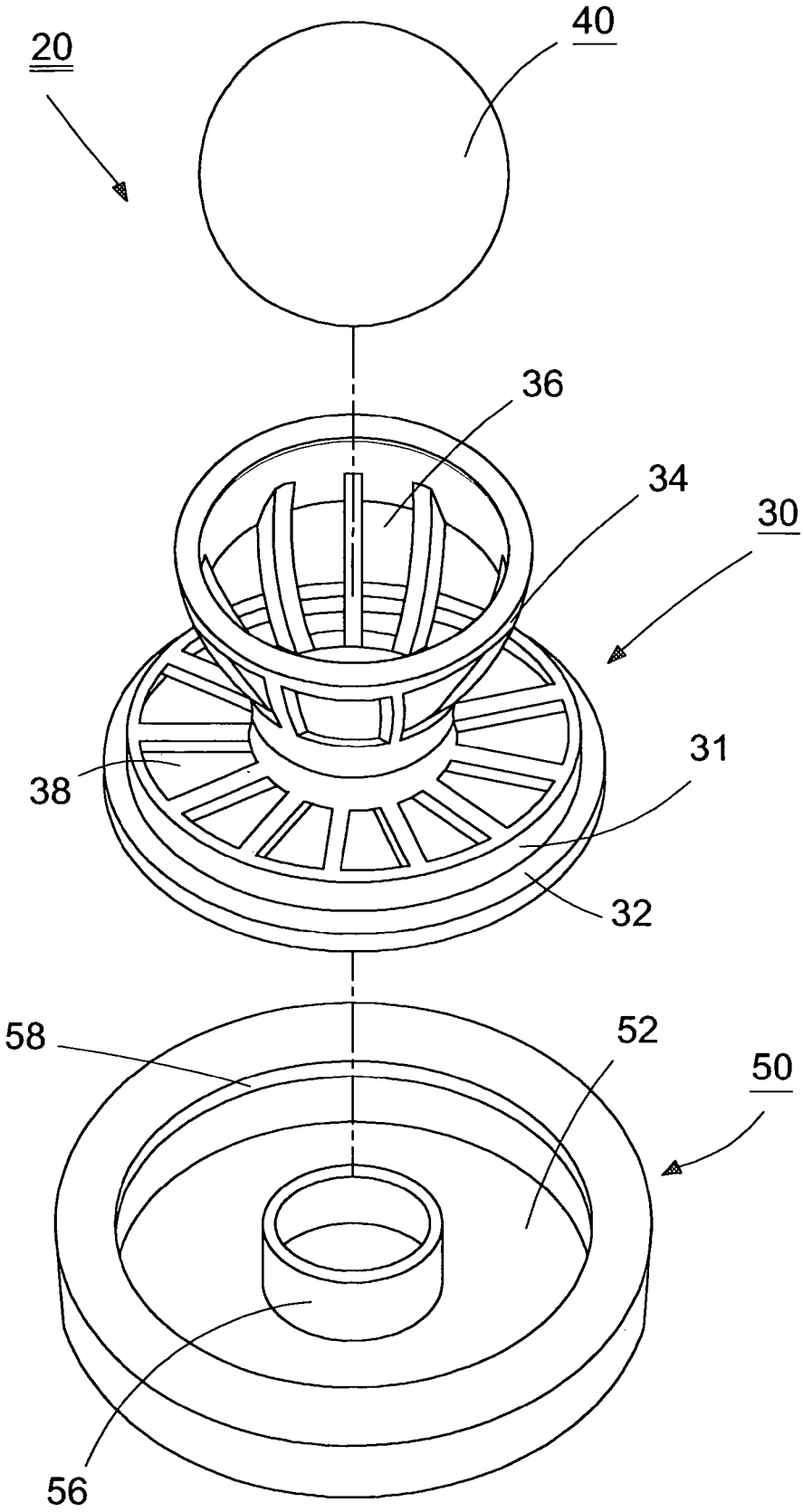
FIG. 3 is a perspective exploded view of the FIG. 2.
Figure 4:
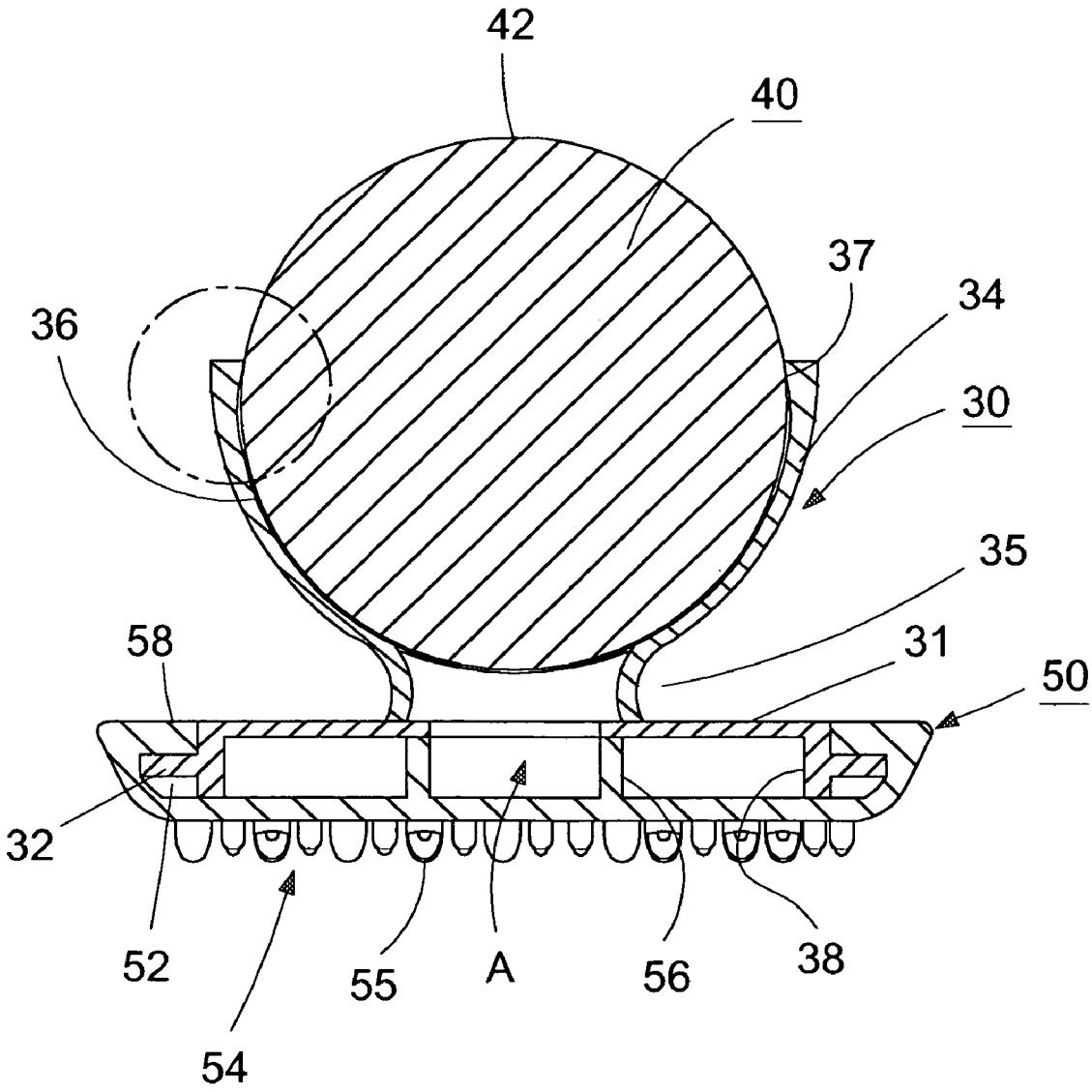
FIG. 4 is a longitudinal sectional view according to FIG. 2.
Figure 5:
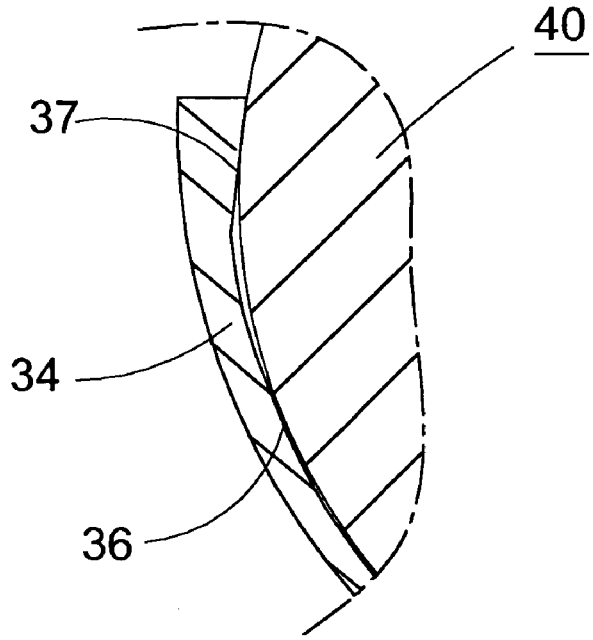
FIG. 5 is an enlarged view of the circled area of FIG. 4.

Please refer to FIGS. 2 and 3. The handheld massager 20 of the present invention includes a main body 30 made of plastic material. The main body 30 includes a tray body 31 having an annular rib 32 formed along outer circumference of the tray body 31. A holding section 34 is formed on top face of the tray body 31. The outer diameter of the holding section 34 is downward tapered, whereby the outer circumference of the main body is formed with an inward recessed holding region 35 as shown in FIG. 4. The holding region 35 is defined between the tray body 31 and is a conic inward recess. The top face of the holding section 34 is depressed to form a semispherical cavity 36. An engaging section 37 is annularly formed on inner wall of the opening of the cavity 36 as shown in FIG. 5. The engaging section 37 inward protrudes from the inner wall of the opening of the cavity 36. The thickness of the longitudinal section of the engaging section 37 is downward tapered. In addition, referring to FIG. 4, the bottom face of the tray body 31 is formed with a dent 38.

A first massaging member 40 which is a ball body mounted in the cavity 36 of the holding section 34. The top end of the massaging member 40 protrudes from the main body 30 to form a first massaging face 42. When the first massaging member 40 is mounted in the cavity 36, the engaging section 37 is engaged with the massaging member 40 to prevent it from dropping out of the cavity 36. The first massaging member 40 can be rolled within the cavity 36.

Figure 6:
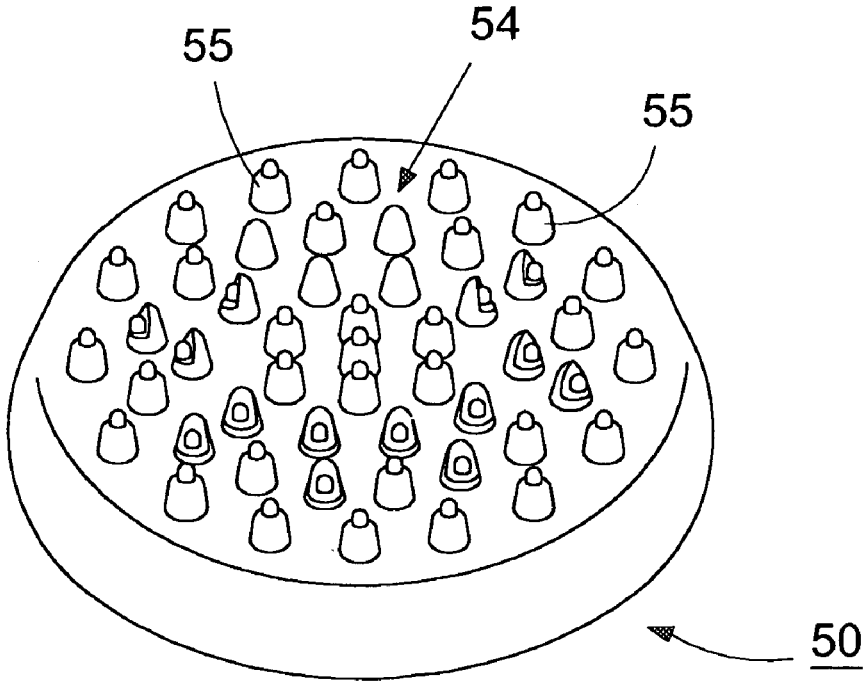
FIG. 6 is a bottom perspective view of the second massaging member of the FIG. 2.

A second massaging member 50 made of soft material. The second massaging member 50 is substantially bowl-shaped. The top face of which is depressed to form a depression 52. The bottom face of which is a second massaging face 54 having embossed structure as shown in FIG. 6. Multiple protuberances 55 are densely distributed over the second massaging face 54. A predetermined number of annular projecting walls 56 are formed in the depression 52 of the second massaging member 50. In this embodiment, there is one projecting wall 56 disposed in the depression 52. An annular latch flange 58 is formed on inner circumference of the second massaging member 50 for latching with the annular rib 32 of the main body 30 as shown in FIG. 4. Accordingly, the second massaging member 50 covers the bottom end of the main body 30. The dent 38 of the bottom face of the main body 30 and the depression 52 of the top face of the second massaging member 50 communicate with each other to together form a space A. The top end of the projecting wall 56 of the massaging member 50 abuts against the bottom face of the tray body 31.

Figure 7:
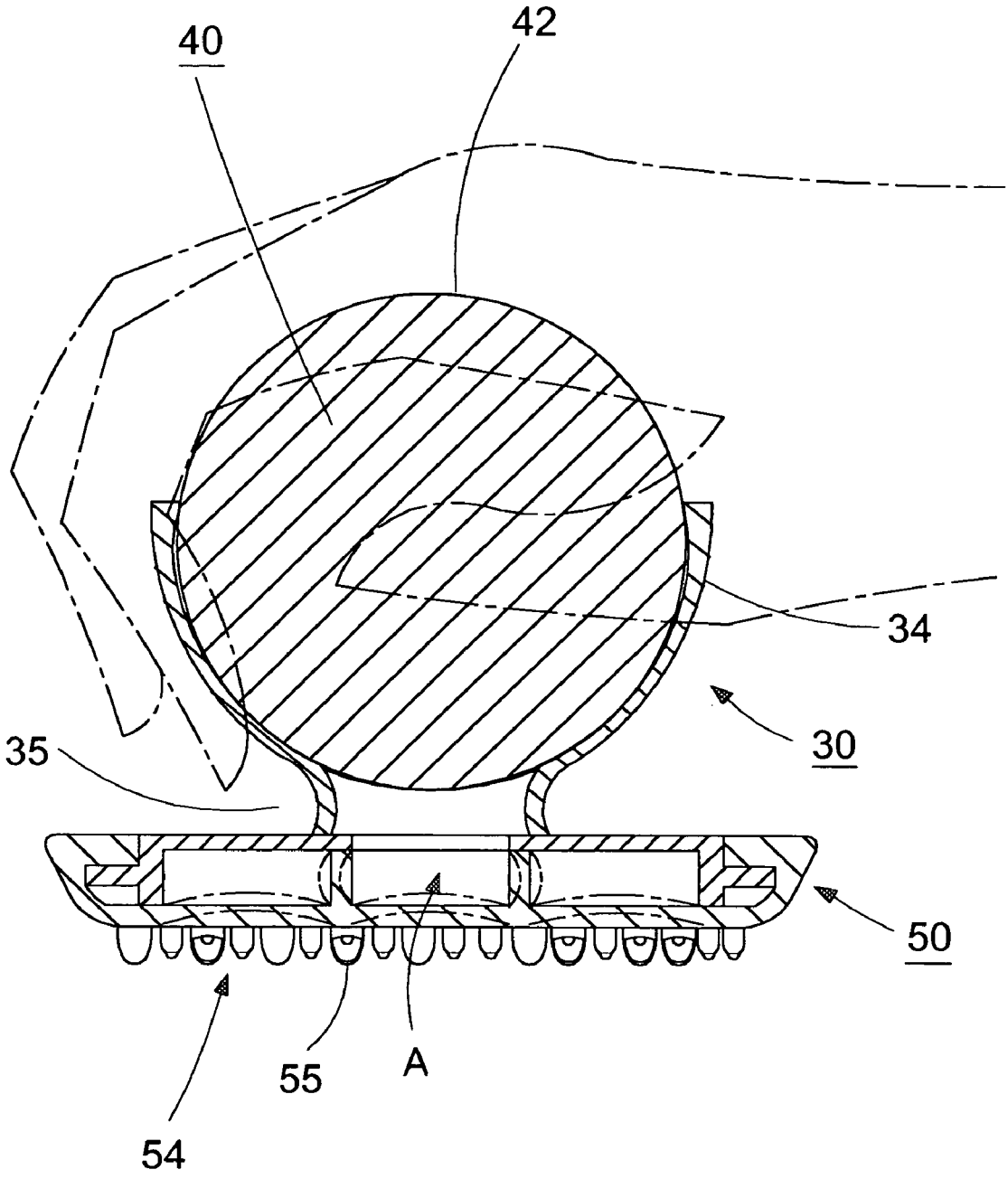
FIGS. 7 and 8 show the use of the present invention.

The present invention can be used in two manners. FIG. 7 shows that the second massaging member 50 is used to provide massaging function. A user holds the main body 30 and the first massaging member 40 with the palm contacting with the spherical massaging face 42 of the first massaging member 40. At this time, the user's hand will has a very smooth touch feeling. The convex spherical face will just snugly attach to the concave palm. The user's fingers grasp the holding region 35 which enables the user's hand to firmly hold the main body. The present invention has a configuration meeting human engineering for a user to more effectively and comfortably hold.

When massaging the body, the second massaging face 54 of the second massaging member 50 is pressed against the skin and pushed back and forth. The protuberances 55 contact with the skin to provide point massaging effect and fat-pushing effect for eliminating and softening adipose so as to thin the body. Also, the massaged portion exerts a reaction force onto the second massaging member 50. The space A permits the second massaging member 50 to resiliently deform and inward displace. Therefore, the second massaging member 50 is waved and inward displaced corresponding to the curve of the body as shown by the phantom line. Accordingly, during the massaging procedure, the second massaging member 50 is fully snugly attached to the surface of the body to provide good massaging and fat-pushing effect.

Figure 8:
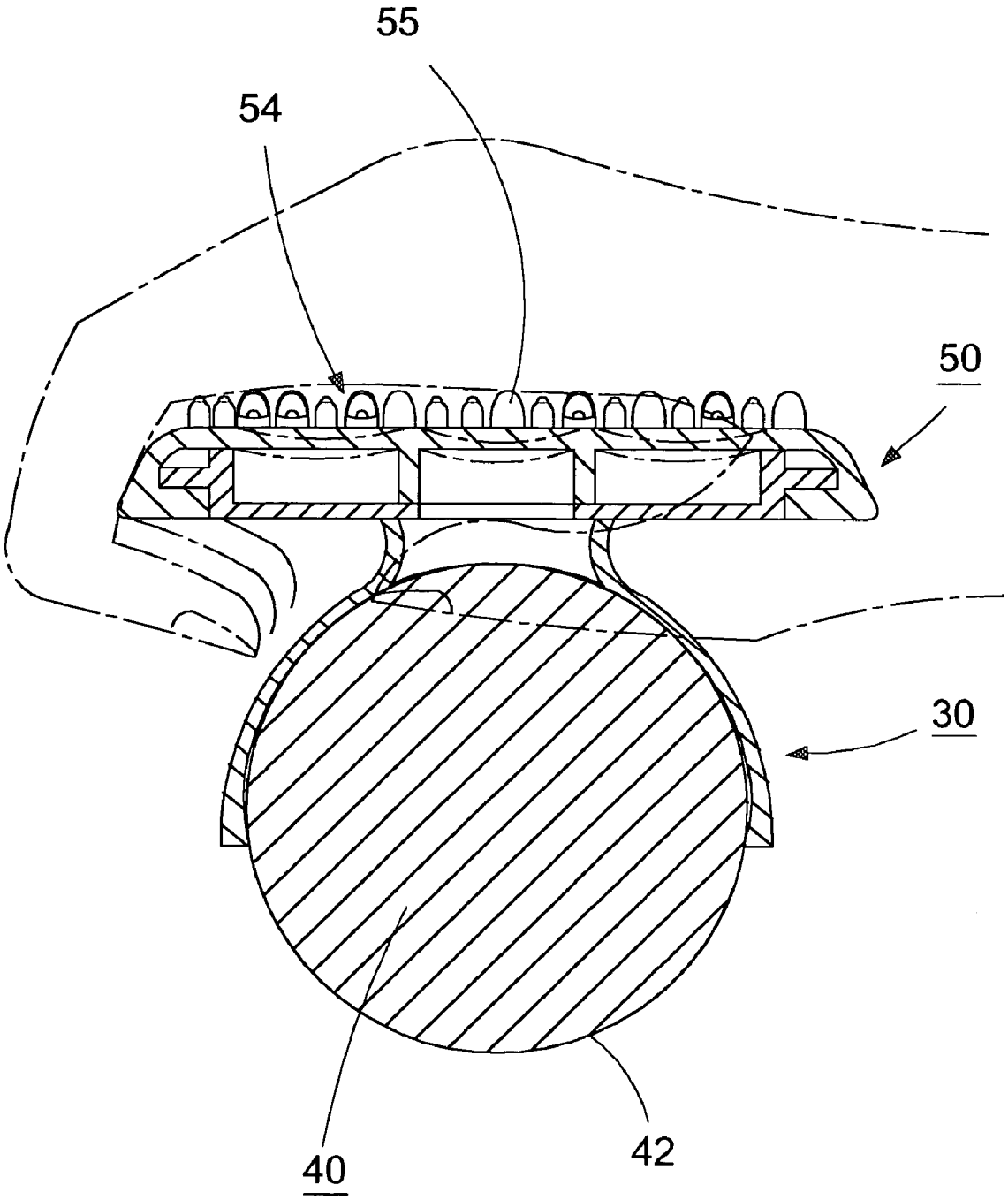

Alternatively, the present invention can be used in another manner as shown in FIG. 8. A user holds the second massaging member 50 with the palm contacting with the second massaging face 54. The first massaging member 40 is back and forth rolled on the human body to massage the same. The first massaging face 42 can provide different massaging effects with different feelings. When the palm exerts a force onto the massager, the second massaging face 54 applies a reaction force onto the palm. At this time, the protuberances 55 provide massaging and stimulating effect for the vital points of the palm. The above massaging procedure can achieve double massaging effects. Not only the human body and skin are massaged, but also the vital points of the palm are pressed and massaged by the protuberances. It can be known from medical reports that by means of massaging the vital points of the palm, a cultivating and maintenance effect is provided for human organs.

Figure 9:
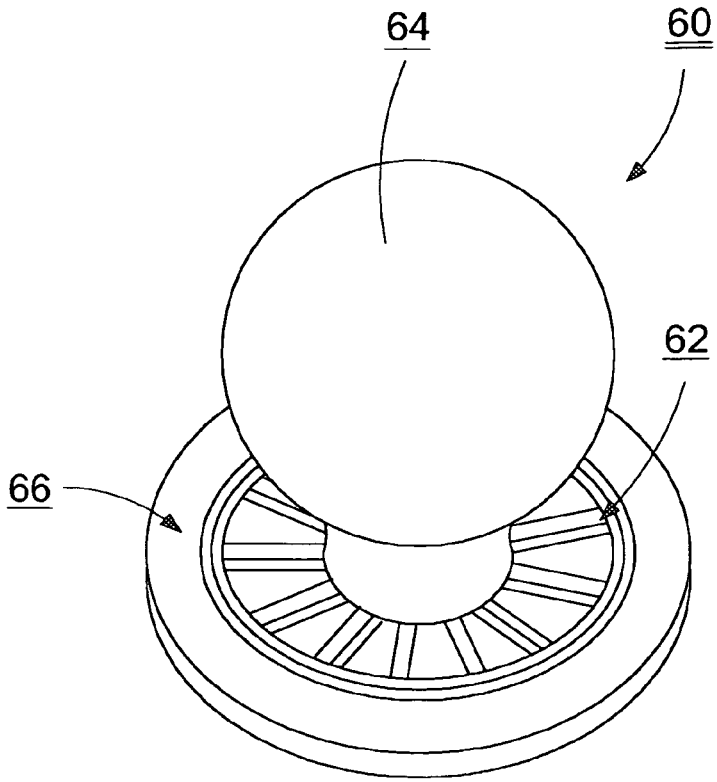
FIG. 9 is a perspective assembled view of a second embodiment of the massager of the present invention.
Figure 10:
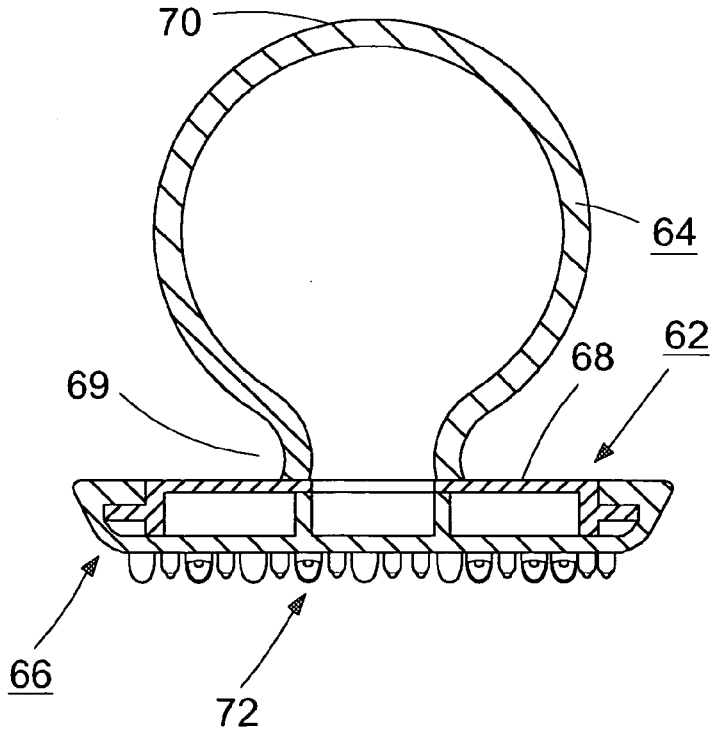
FIG. 10 is a longitudinal sectional view according to FIG. 9.

FIGS. 9 and 10 show a second embodiment of the massager 60 of the present invention. The massager 60 includes a main body 62, a first massaging member 64 and a second massaging member 66, wherein the second massage member and the cooperative structure of the main body are identical to those of the first embodiment.

In the embodiment, the first massaging member 64 is a spherical body, the bottom end of which is directly fixed connected with the tray body 68 of the main body 62. Similarly, a conic inward recessed holding region 69 is defined between the first massaging member 64 and the main body 62.

In the embodiment, the first and second massaging faces 70, 72 provide different massaging effects. The second massaging face 72 also provides fat-pushing and body-thinning effect and serves to stimulate the vital points of the palm.

Figure 11:
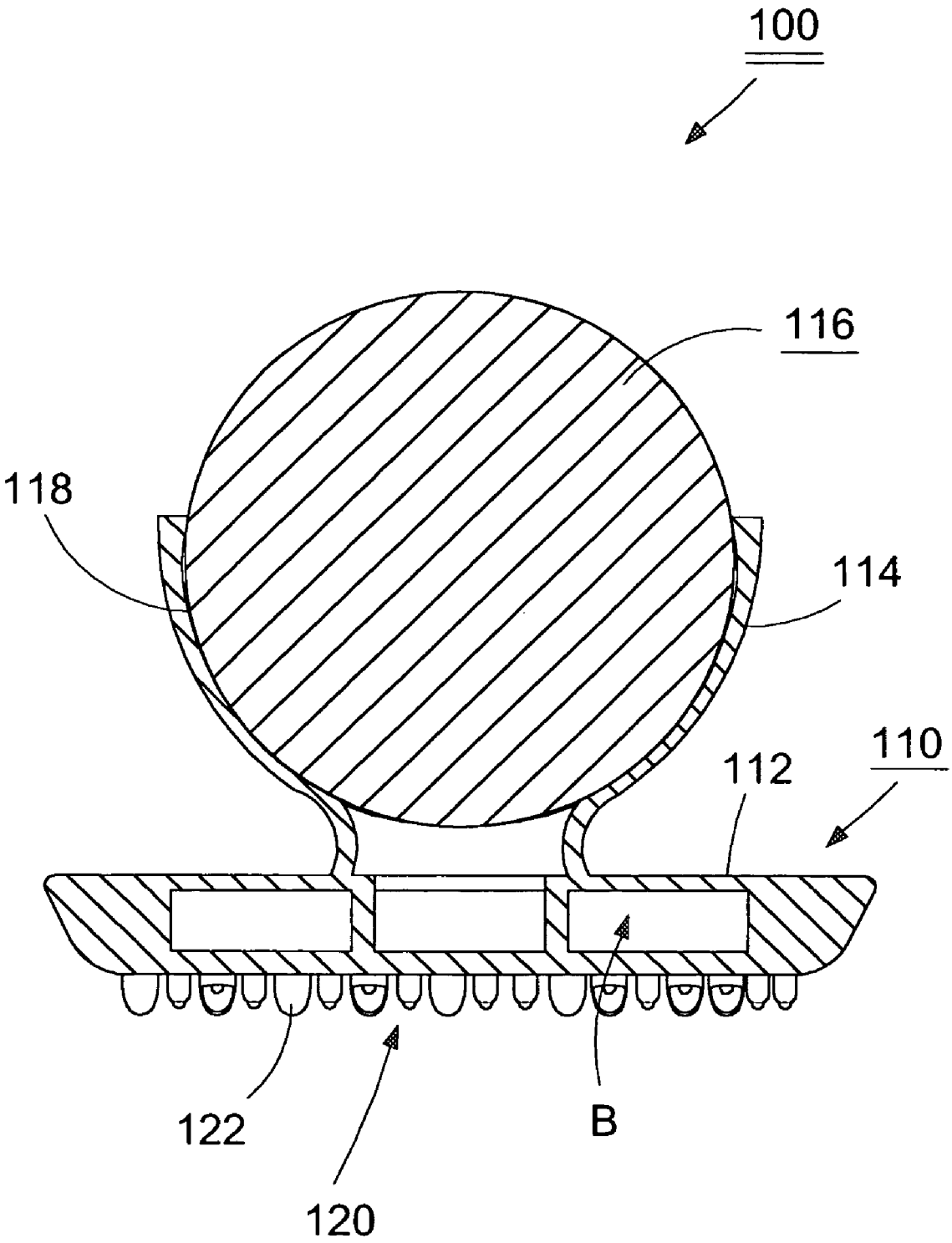
FIG. 11 is a longitudinal sectional view of a third embodiment of the massager of the present invention.

FIG. 11 shows a third embodiment of the massager 100 of the present invention, in which a holding section 114 is disposed on the top face of the tray body 112 of the main body 110. A first massaging member 116 is mounted in the cavity 118 of the holding section and can be rolled.

The bottom face of the main body 110 directly serves as a second massaging face 120 having multiple protuberances 122. A space B is formed inside the main body 110, permitting the second massaging face 120 to wave corresponding to the curve of a user's body.

The present invention provides different massaging effects and is convenient to hold.

The above embodiments are only used to illustrate the present invention, not intended to limit the scope thereof. Many modifications of the above embodiments can be made without departing from the spirit of the present invention.

What is claimed is:

1. A handheld massager comprising:

a main body including a tray body and a holding section formed on top face of the tray body, a top face of the holding section being depressed to form a cavity;

a first massaging member which is a ball body undetachably and rollably mounted in the cavity of the holding section, a top end of the first massaging member protruding from the cavity to form a first massaging face; and a second massaging member disposed under bottom end of the tray body of the main body, a bottom face of the second massaging member serving as a second massaging face having embossed structure.

2. The handheld massager as claimed in claim 1, wherein a circumference of the holding section is formed with an inward recessed holding region.

3. The handheld massager as claimed in claim 2, wherein outer diameter of the holding section is downward tapered, whereby the holding region is a conic inward recess.

4. The handheld massager as claimed in claim 1, wherein multiple protuberances are distributed over the second massaging face of the second massaging member.

5. The handheld massager as claimed in claim 1, wherein the second massaging member is made of soft material, a space being defined between the main body and the second massaging member, whereby a force is applied to the second massaging face, the second massaging face can be inward displaced to the space.

6. The handheld massager as claimed in claim 1, wherein the second massaging member is a substantially bowl-shaped body covering bottom end of the tray body of the main body.

7. The handheld massager as claimed in claim 6, wherein an annular rib is formed along the circumference of the tray body of the main body and an annular latch flange is formed on inner circumference of the second massaging member for latching with the annular rib of the main body.

8. The handheld massager as claimed in claim 6, wherein a space is defined between the tray body of the main body and the second massaging member, the second massaging member being made of soft material, whereby a force is applied to the second massaging face, the second massaging member can be inward displaced to the space.

9. The handheld massager as claimed in claim 8, wherein the bottom face of the tray body of the main body is inward recessed to form a dent which serves as the space.

10. The handheld massager as claimed in claim 8, wherein the top face of the second massaging member is depressed to form a depression which serves as the space.

11. The handheld massager as claimed in claim 9, wherein the top face of the second massaging member is depressed to form a depression, the dent of the main body and the depression of the second massaging member communicating with each other to together form the space.

12. The handheld massager as claimed in claim 10, wherein at least one projecting wall is formed in the depression of the second massaging member, a top end of the projecting wall abutting against the bottom face of the tray body of the main body.

13. The handheld massager as claimed in claim 1, wherein an engaging section is formed on inner wall of the opening of the cavity of the holding section for engaging with the first massaging member and preventing the first massaging member from dropping out of the cavity.

14. The handheld massager as claimed in claim 13, wherein the engaging section is annularly formed on inner wall of the opening of the cavity and inward protrudes from the inner wall of the opening of the cavity, a thickness of the longitudinal section of the engaging section being downward tapered.

15. A handheld massager comprising:

a main body, a holding section formed on top face of the main body, a top face of the holding section being depressed to form a cavity, a circumference of the holding section is formed with an inward recessed holding region;

a first massaging member rollably mounted in the cavity of the holding section, a top end of the first massaging member protruding from the cavity, a top face of the first massaging member being formed a first massaging face; and a second massaging face disposed on a bottom face of the main body, the second massaging face having embossed structure.

16. The handheld massager as claimed in claim 15, wherein a space is formed inside the main body, whereby a force is applied to the second massaging face, the second massaging member can be inward displaced to the space.

* * * * *